US007104525B2

(12) United States Patent
Ricci

(10) Patent No.: US 7,104,525 B2
(45) Date of Patent: Sep. 12, 2006

(54) FENCE POST PROTECTING APPARATUS

(76) Inventor: Jeffrey W. Ricci, 125 S. 9th St., Coopersburg, PA (US) 18036

( * ) Notice: Subject to any disclaimer, the term of this patent is extended or adjusted under 35 U.S.C. 154(b) by 0 days.

(21) Appl. No.: 10/923,642

(22) Filed: Aug. 23, 2004

(65) Prior Publication Data

US 2006/0038163 A1 Feb. 23, 2006

(51) Int. Cl.
*E04H 17/014* (2006.01)

(52) U.S. Cl. ..... 256/65.14; 256/1; 256/19; 47/32.4

(58) Field of Classification Search ..... 256/1, 256/65.14, DIG. 5, 59, 19; 47/33, 32.4, 47/32.5, 31.1, 30, 32, 20.1
See application file for complete search history.

(56) References Cited

U.S. PATENT DOCUMENTS 1,532,734 A * 4/1925 Dean ..... 52/170
1,999,098 A 4/1935 Hillyer et al.
3,477,181 A * 11/1969 Robison ..... 52/27
4,845,889 A 7/1989 Taylor
5,178,369 A * 1/1993 Syx ..... 256/32
5,369,925 A 12/1994 Vargo
5,375,369 A * 12/1994 VerHoeve ..... 47/33
5,452,541 A * 9/1995 DeMaio ..... 47/33
5,503,371 A 4/1996 Bies
5,622,356 A * 4/1997 Duggan ..... 256/1
5,685,522 A 11/1997 Randolph, Jr.
5,832,675 A * 11/1998 Zuares ..... 52/60
6,257,557 B1 * 7/2001 Anderson et al. ..... 256/1
6,276,869 B1 * 8/2001 Yakushinji ..... 404/9
6,523,808 B1 * 2/2003 Lehmann ..... 256/65.14
6,527,255 B1 * 3/2003 O'Berry et al. ..... 256/1

* cited by examiner

*Primary Examiner*—Gregory J. Binda
*Assistant Examiner*—Daniel Mills

(57) ABSTRACT

An apparatus for shielding a fence post from foreign elements includes a collar section with integral sidewalls, one detachable sidewall, a base extending about a perimeter of the collar section, and a mechanism for preventing fluid from traveling distally and medially of an outer wall of the fence post and an inner perimeter of the collar. The detachable sidewall is provided with oppositely spaced tongue portion and the collar section has a pair of grooves formed therein. The tongue and groove portions are slidably engageable with each other so that the apparatus can be assembled and disassembled by moving the detachable sidewall along a substantially vertical plane. The fluid blocking mechanism preferably includes a rubber seal contiguously positioned medially of the fence post and collar section.

15 Claims, 4 Drawing Sheets

FENCE POST PROTECTING APPARATUS

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to outdoor post protectors and, more particularly, to a detachable protective cover for shielding a fence post from foreign elements.

2. Prior Art

Much of the residential and commercial property in this country uses fencing to provide privacy and/or define property lines. While the fencing itself is relatively maintenance-free, vegetation abutting such fencing, particularly lawns, requires regular and frequent maintenance in the form of trimming.

Many forms of fencing, particularly privacy fencing which uses square wooden fence posts, have corners between the fence posts and the fencing where vegetation can grow and attempts to trim around these posts often results in damage to the posts and/or to the trimmer's monofilament line. Sharp corners on square fence posts are particularly damaging to monofilament line and may even sever the line. This drastically reduces the useful life of a standard line supply for such a trimmer. In addition to the waste of monofilament, this results in a waste of time while the monofilament supply is replaced and the trimmer is rethreaded.

Furthermore, exposure to rain, snow, and extreme temperatures may cause the wooden posts to swell, shrink, crack, or warp. The physical deformities caused be environmental factors can result in the need for the fence to be replaced. These conditions thus result in extra maintenance that must be expended on a fence in order to keep the fence sturdy and functional.

Accordingly, a need remains for a fence post protecting apparatus to overcome the above noted shortcomings. The present invention satisfies such a need by providing a protective cover that is easy to install, durable, cost effective and effectively provides fence post protection from yard tools. The apparatus will also enhance the appearance of posts that have been previously damaged.

BRIEF SUMMARY OF THE INVENTION

In view of the foregoing background, it is therefore an object of the present invention to provide an apparatus for protecting fence posts. These and other objects, features, and advantages of the invention are provided by an apparatus for shielding a fence post from foreign elements.

The apparatus includes a collar section formed from non-corrodible material that is removably positionable about a lower portion of the fence post. Such a collar portion includes a plurality of integral sidewalls defining a substantially U-shape, for example. Of course, the collar section may be sized and shaped to fit about various fence posts, well known in the industry. The plurality of sidewalls have substantially planar front and rear surfaces and centrally disposed longitudinal axes respectively. Such a plurality of sidewalls further have opposed edge portions equally spaced from the respective axes and extending substantially parallel thereto. One of the plurality of sidewalls is detachable from the collar section so that the collar section can be selectively positioned about the fence post as desired by a user.

Such a sidewall preferably includes a pair of oppositely spaced tongue portions extending laterally and outwardly away from the opposed edge portions. Such tongue portions may be equally spaced from the respective axis and may extend substantially parallel thereto. Select ones of the plurality of sidewalls are further provided with a groove adjacent to one of the opposed edge portions thereof, respectively. The pair of tongue portions are slidably positionable within the grooves so that the sidewall can be selectively disengaged with the remaining sidewalls by moving the sidewall along a substantially vertical plane.

The present invention also includes a base portion integral with the plurality of sidewalls and extending about a perimeter of the collar section. The base portion defines a flange portion that has a top surface sloping downwardly and away from the fence post. Such a base portion is preferably contiguous with the plurality of sidewalls and is engageable with a ground surface for effectively assisting to maintain the collar section at a substantially stable position during operating conditions. Advantageously, fluid is conveniently directed outwardly and away from the plurality of sidewalls so that the apparatus does not become damaged from environmental conditions.

The apparatus further includes a mechanism for preventing fluid from traveling distally and medially of an outer wall of the fence post and an inner perimeter of the collar section. Such a preventing mechanism is connected to the collar section. The preventing mechanism preferably includes a flexible rubber seal positioned along an upper portion of the collar section. Such a rubber seal has a sufficient thickness for effectively maintaining continuous contact with the outer surface of the fence post. The rubber seal preferably includes first and second sections connected to the sidewall and the remaining sidewalls, respectively, so that the first section can effectively be separated from the second section when sidewall is detached from the collar section. Of course, other suitable sealers may be employed, without departing from the true scope of the invention.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
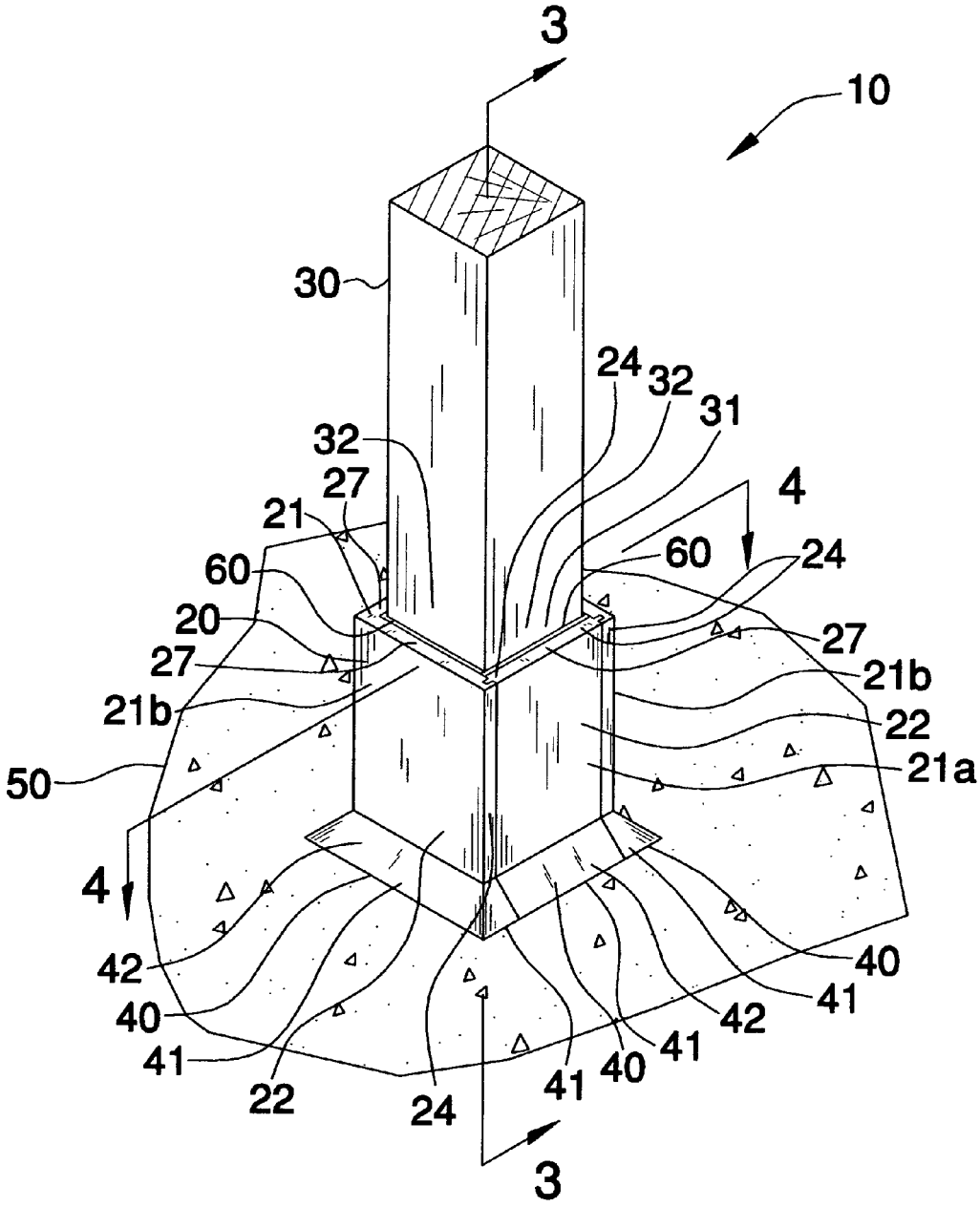
FIG. 1 is a perspective view showing a fence post protecting apparatus, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1–4 by the reference numeral 10 and is intended to provide a fence post protector. It should be understood that the apparatus 10 may be used to protect many different types of structures and should not be limited to only conventional fence posts having a square cross-section.

Referring initially to FIG. 1, the apparatus 10 includes a collar section 20 formed from non-corrodible material that is removably positionable about a lower portion 31 of the fence post 30. Conveniently, the collar section 20 may be produced in a variety of colors in order to match the variety of fence posts 30 available in the industry. Such a collar portion 20 includes a plurality of integral sidewalls 21 defining a substantially U-shape, for example. Of course, the collar section 20 may be sized and shaped to fit about various fence posts 30, well known in the industry. The plurality of sidewalls 21 have substantially planar front 22 and rear 23 surfaces and centrally disposed longitudinal axes respectively. Such a plurality of sidewalls 21 further have opposed edge portions 24 equally spaced from the respective axes and extending substantially parallel thereto.

Figure 2:
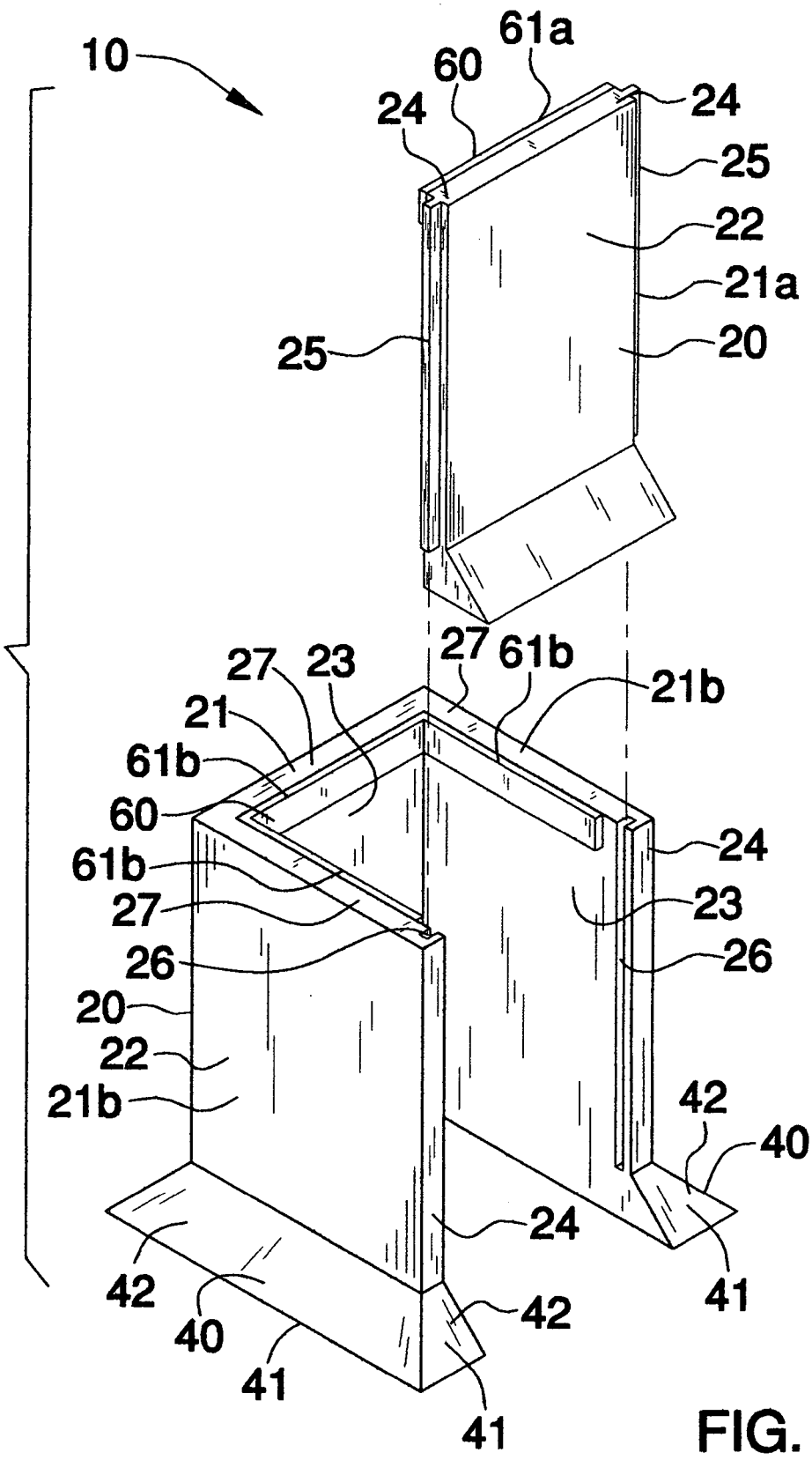
FIG. 2 is an enlarged perspective view of the apparatus shown in FIG. 1, showing one sidewall to be detachable from the collar section.

As can be seen in FIG. 2, one of the plurality of sidewalls 21*a* is detachable from the collar section 20 so that the collar section 20 can be selectively positioned about the fence post 30 as desired by a user. Once the apparatus 10 is engaged about a fence post 30 it advantageously protects the lower portion 31 from damage usually inflicted by yard tools such as electric trimmers and clippers.

As shown in FIGS. 2 and 40, such a sidewall 21*a* includes a pair of oppositely spaced tongue portions 25 extending laterally and outwardly away from the opposed edge portions 24. Such tongue portions 25 are equally spaced from the respective axis and extends substantially parallel thereto. Select ones of the plurality of sidewalls 21*b* are further provided with a groove 26 adjacent to one of the opposed edge portions 24 thereof, respectively. The pair of tongue portions 25 are slidably positionable within the grooves 26 so that the sidewall 21*a* can be selectively disengaged with the remaining sidewalls 21 by moving the sidewall 21*a* along a substantially vertical plane. This feature allows for easy attachment and detachment of the apparatus 10 when desired by a user in the event that they might move or need to paint the fence post 30.

Figure 3:
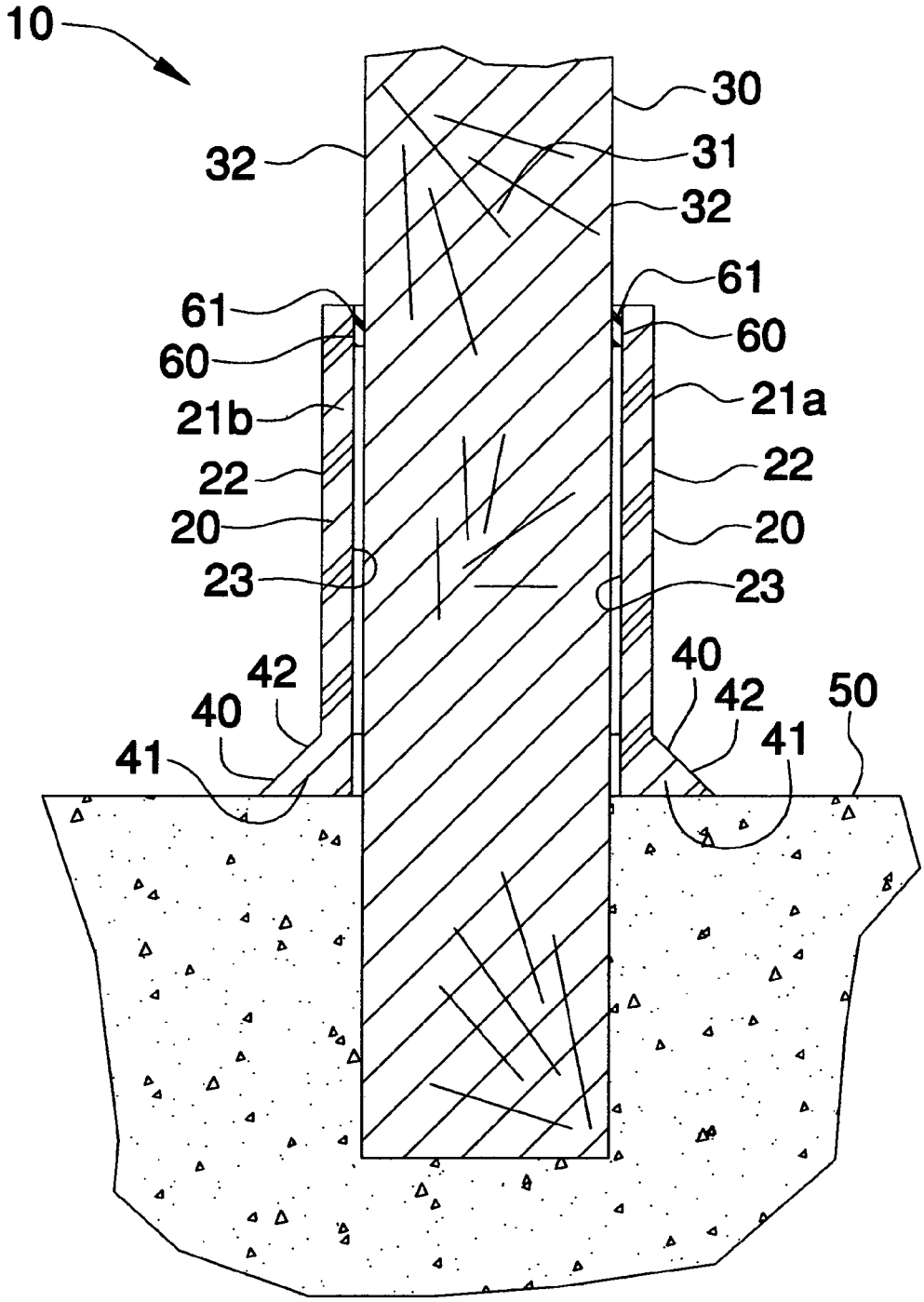
FIG. 3 is an enlarged cross-sectional view of the apparatus shown in FIG. 1, taken along line 3—3.

The present invention also includes a base portion 40 integral with the plurality of sidewalls 21 and extending about a perimeter of the collar section 20. The base portion 40 defines a flange portion 41 that has a top surface 42 sloping downwardly and away from the fence post 30. Referring to FIGS. 1 and 3, such a base portion 40 is contiguous with the plurality of sidewalls 21 and is engageable with a ground surface 50 for effectively assisting to maintain the collar section 20 at a substantially stable position during operating conditions. Advantageously, fluid is conveniently directed outwardly and away from the plurality of sidewalls 21 so that the apparatus 10 does not become damaged from environmental conditions.

Figure 4:
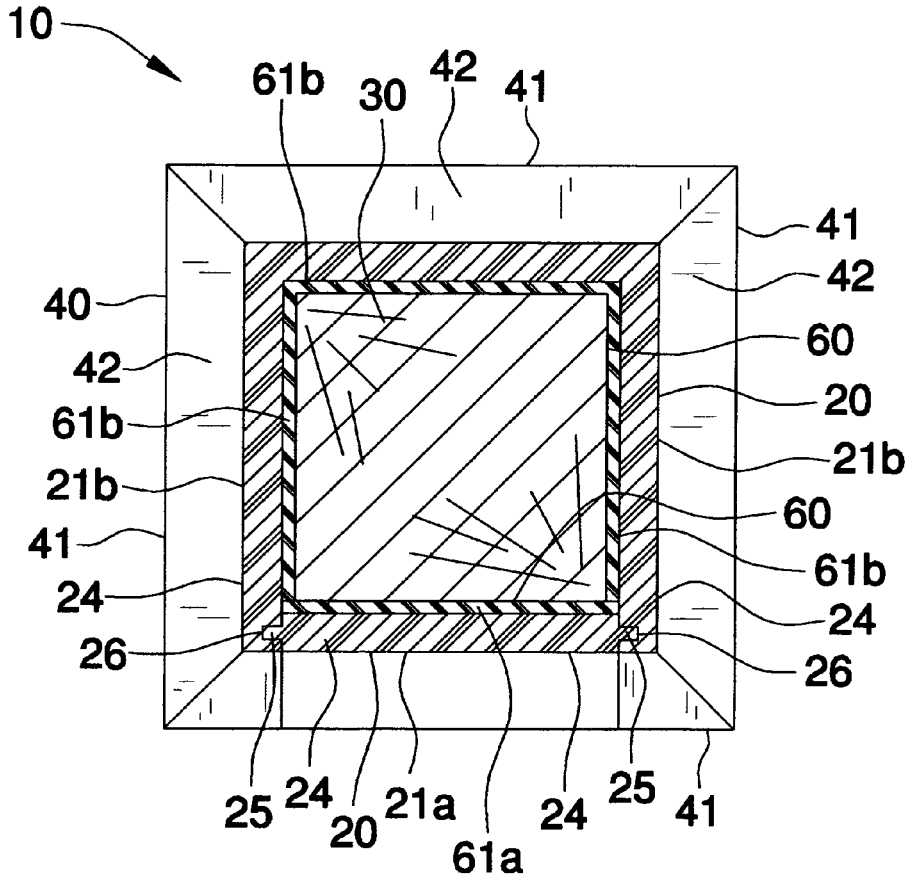
FIG. 4 is an enlarged cross-sectional view showing the rubber seal positioned about the fence post, taken along line 4—4.

The apparatus 10 further includes a mechanism 60 for preventing fluid from traveling distally and medially of an outer wall 32 of the fence post 30 and an inner perimeter of the collar section 20. Such a preventing mechanism 60 is connected to the collar section 20. The preventing mechanism 60 includes a flexible rubber seal 61 positioned along an upper portion 27 of the collar section 20. As is illustrated in FIG. 4, such a rubber seal 61 has a sufficient thickness for effectively maintaining continuous contact with the outer surface 32 of the fence post 30, thus forming an impenetrable seal that advantageously prevents access to fluids. If such fluids had access to the fence post 30 it might lead to rotting and the need of replacing the fence post 30. The rubber seal 61 includes first 61*a* and second sections 61*b* connected to the sidewall 21*a* and the remaining sidewalls 21, respectively, so that the first section 61*a* can effectively be separated from the second section 61*b* when sidewall 21*a* is detached from the collar section 20. Of course, other suitable sealers 60 may be employed, without departing from the true scope of the invention.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. An apparatus for shielding a fence post from foreign elements, said apparatus comprising:

a collar section removably positionable about a lower portion of the fence post and comprising a plurality of integral sidewalls sized and shaped for defining a selected profile, each of said plurality of sidewalls having substantially planar front and rear surfaces corresponding to each side of the post and each of said plurality of sidewalls further having centrally disposed longitudinal axes respectively, said plurality of sidewalls further having opposed edge portions equally spaced from the respective axes and extending substantially parallel thereto, one of said plurality of sidewalls being detachable from said collar section so that said collar section can be selectively positioned about the fence post as desired by a user, a base portion integral with said plurality of sidewalls and extending about a perimeter of said collar section, said base portion being contiguous with said plurality of sidewalls and being engageable with a ground surface for assisting to maintain said collar section at a substantially stable position during operating conditions wherein fluid is directed outwardly and away from said plurality of sidewalls so that said apparatus does not become damaged from environmental conditions, each of said plurality of sidewalls has a respective longitudinal length greater than a respective longitudinal length of each of said base portions, and means for preventing fluid from traveling distally and medially of an outer wall of the fence post and an inner perimeter of said collar section, said preventing means being connected to said collar section, and wherein said one sidewall comprises a pair of oppositely spaced tongue portions extending laterally and outwardly away from said opposed edge portions, selected ones of said plurality of sidewalls being provided with a groove positioned adjacent to one said opposed edge portion thereof respectively, said pair of tongue portions being slidably positionable within the grooves so that said one sidewall can be selectively disengaged with said select sidewalls along a substantially vertical plane and parallel to said respective axes of each of said plurality of sidewalls.

2. The apparatus of claim 1, wherein said base portion defines a flange portion having a top surface sloping downwardly and away from the fence post.

3. The apparatus of claim 1, wherein said preventing means comprises: a flexible rubber seal positioned along an upper portion of said collar section, said rubber seal having a sufficient thickness for maintaining continuous contact with the outer surface of the fence post.

4. The apparatus of claim 3, wherein said rubber seal comprises:

a first section connected to said one sidewall; and a second section connected to remaining ones of said plurality of sidewalls so that said first section can be separated from said second section when said one sidewall is detached from said collar section.

5. The apparatus of claim 1, wherein said pair of tongue portions are equally spaced from the respective axis and extend substantially parallel thereto.

6. An apparatus for shielding a fence post from foreign elements, said apparatus comprising:

a collar section removably positionable about a lower portion of the fence post and comprising a plurality of integral sidewalls defining a substantially U-shape, each of said plurality of sidewalls having substantially planar front and rear surfaces and each of said plurality of sidewalls further having centrally disposed longitudinal axes respectively, said plurality of sidewalls further having opposed edge portions equally spaced from the respective axes and extending substantially parallel thereto, one of said plurality of sidewalls being detachable from said collar section so that said collar section can be selectively positioned about the fence post as desired by a user, a base portion integral with said plurality of sidewalls and extending about a perimeter of said collar section, said base portion being contiguous with said plurality of sidewalls and being engageable with a ground surface for assisting to maintain said collar section at a substantially stable position during operating conditions wherein fluid is directed outwardly and away from said plurality of sidewalls so that said apparatus does not become damaged from environmental conditions, each of said plurality of sidewalls has a respective longitudinal length greater than a respective longitudinal length of each of said base portions, and means for preventing fluid from traveling distally and medially of an outer wall of the fence post and an inner perimeter of said collar section, said preventing means being connected to said collar section, and wherein said one sidewall comprises a pair of oppositely spaced tongue portions extending laterally and outwardly away from said opposed edge portions, select ones of said plurality of sidewalls being provided with a groove adjacent one said opposed edge portion thereof respectively, said pair of tongue portions being slidably positionable within the grooves so that said one sidewall can be selectively disengaged with said select sidewalls along a substantially vertical plane and parallel to said respective axes of each of said plurality of sidewalls.

7. The apparatus of claim 6, wherein said base portion defines a flange portion having a top surface sloping downwardly and away from the fence post.

8. The apparatus of claim 6, wherein said preventing means comprises: a flexible rubber seal positioned along an upper portion of said collar section, said rubber seal having a sufficient thickness for maintaining continuous contact with the outer surface of the fence post.

9. The apparatus of claim 8, wherein said rubber seal comprises:

a first section connected to said one sidewall; and a second section connected to remaining ones of said plurality of sidewalls respectively so that said first section can be separated from said second section when said one sidewall is detached from said collar section.

10. The apparatus of claim 6, wherein said pair of tongue portions are equally spaced from the respective axis and extend substantially parallel thereto.

11. An apparatus for shielding a fence post from foreign elements, said apparatus comprising:

a collar section formed from non-corrodible material and being removably positionable about a lower portion of the fence post, said collar portion comprising a plurality of integral sidewalls defining a substantially U-shape, each of said plurality of sidewalls having substantially planar front and rear surfaces and each of said plurality of sidewalls further having centrally disposed longitudinal axes respectively, said plurality of sidewalls further having opposed edge portions equally spaced from the respective axes and extending substantially parallel thereto, one of said plurality of sidewalls being detachable from said collar section so that said collar section can be selectively positioned about the fence post as desired by a user, a base portion integral with said plurality of sidewalls and extending about a perimeter of said collar section, said base portion being contiguous with said plurality of sidewalls and being engageable with a ground surface for assisting to maintain said collar section at a substantially stable position during operating conditions wherein fluid is directed outwardly and away from said plurality of sidewalls so that said apparatus does not become damaged from environmental conditions, each of said plurality of sidewalls has a respective longitudinal length greater than a respective longitudinal length of each of said base portions, and means for preventing fluid from traveling distally and medially of an outer wall of the fence post and an inner perimeter of said collar section, said preventing means being connected to said collar section, and wherein said one sidewall comprises a pair of oppositely spaced tongue portions extending laterally and outwardly away from said opposed edge portions, select ones of said plurality of sidewalls being provided with a groove adjacent one said opposed edge portion thereof respectively, said pair of tongue portions being slidably positionable within the grooves so that said one sidewall can be selectively disengaged with said select sidewalls along a substantially vertical plane and parallel to said respective axes of each of said plurality of sidewalls.

12. The apparatus of claim 11, wherein said base portion defines a flange portion having a top surface sloping downwardly and away from the fence post.

13. The apparatus of claim 11, wherein said preventing means comprises: a flexible rubber seal positioned along an upper portion of said collar section, said rubber seal having a sufficient thickness for maintaining continuous contact with the outer surface of the fence post, said rubber seal being completely disposed beneath a top edge of said collar section.

14. The apparatus of claim 13, wherein said rubber seal comprises:

a first section connected to said one sidewall; and a second section connected to remaining ones of said plurality of sidewalls respectively so that said first section can be separated from said second section when said one sidewall is detached from said collar section.

15. The apparatus of claim 11, wherein said pair of tongue portions are equally spaced from the respective axis and extend substantially parallel thereto.

* * * * *